US010118669B2

(12) United States Patent
Klare

(10) Patent No.: US 10,118,669 B2
(45) Date of Patent: Nov. 6, 2018

(54) VOLUME ELEMENT

(71) Applicant: Stefan Klare, Munich (DE)

(72) Inventor: Stefan Klare, Munich (DE)

( * ) Notice: Subject to any disclaimer, the term of this patent is extended or adjusted under 35 U.S.C. 154(b) by 81 days.

(21) Appl. No.: 14/398,824

(22) PCT Filed: Apr. 30, 2013

(86) PCT No.: PCT/EP2013/059042
§ 371 (c)(1),
(2) Date: Feb. 11, 2015

(87) PCT Pub. No.: WO2013/164360
PCT Pub. Date: Nov. 7, 2013

(65) Prior Publication Data

US 2015/0147925 A1 May 28, 2015

(30) Foreign Application Priority Data

May 4, 2012 (DE) ..... 10 2012 103 948

(51) Int. Cl.
*B63B 7/08* (2006.01)
*B63B 35/79* (2006.01)
(Continued)

(52) U.S. Cl.
CPC ..... *B63B 7/08* (2013.01); *B63B 35/58* (2013.01); *B63B 35/73* (2013.01); *B63B 35/79* (2013.01);
(Continued)

(58) Field of Classification Search
CPC ..... B63B 35/7913; B63B 7/08; B63B 7/082; B63B 2027/145; B63C 9/04; B60C 5/20;
(Continued)

(56) References Cited

U.S. PATENT DOCUMENTS 5,101,752 A 4/1992 Smollar et al.
6,209,962 B1 * 4/2001 Sobel ..... A47C 3/16 297/452.17
(Continued)

FOREIGN PATENT DOCUMENTS

DE 3333473 A1 4/1985
EP 0060409 A1 9/1982
(Continued)

OTHER PUBLICATIONS

International Preliminary Report and Written Opinion of the International Searching Authority from PCT/EP2013/059042 dated Nov. 13, 2014, 6 pages. (English Language Translation).
(Continued)

*Primary Examiner* — Andrew Polay
(74) *Attorney, Agent, or Firm* — Fitch, Even, Tabin & Flannery LLP

(57) ABSTRACT

The invention relates to a volume element (10) comprising at least one inner chamber (12), which is bordered by an at least substantially flexible material and which can be inflated with a gas, and comprising at least one outer chamber (14), which is bordered by an at least substantially flexible material, which is fluidically separated from the at least one inner chamber (12), and which surrounds at least some regions of the outer circumference of the inner chamber (12). Granular material is received in the outer chamber (14) for absorbing pressure forces acting on the volume element (10) from the direction of the outer chamber (14).

14 Claims, 5 Drawing Sheets

Figure 1:
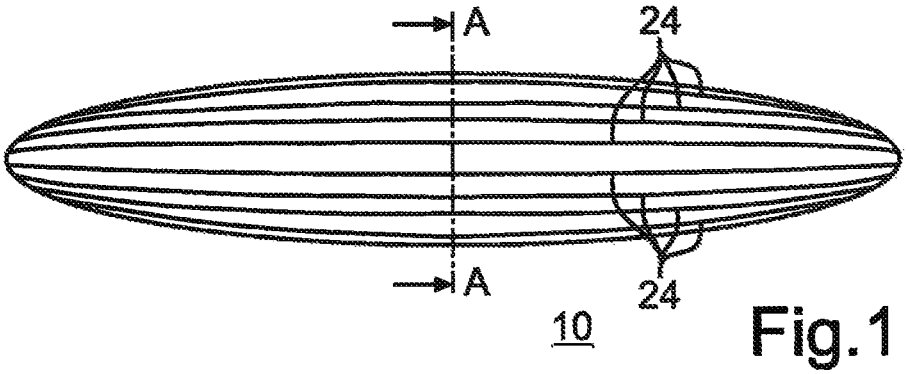

(51) Int. Cl.
*B63B 35/58* (2006.01)
*B63B 35/73* (2006.01)
*E04C 3/00* (2006.01)

(52) U.S. Cl.
CPC ..... *B63B 35/7913* (2013.01); *B63B 35/7916* (2013.01); *E04C 3/005* (2013.01)

(58) Field of Classification Search
CPC ..... B60C 5/22; B60C 5/24; A47C 27/081; A47C 27/086; E04C 3/005
See application file for complete search history.

(56) References Cited

U.S. PATENT DOCUMENTS 6,241,568 B1 6/2001 Simms
6,463,699 B1 * 10/2002 Bailey ..... E04C 3/005 138/115
2006/0144313 A1 * 7/2006 Toussi ..... B63B 35/71 114/345
2009/0004936 A1 1/2009 Mollis
2009/0049757 A1 2/2009 Potter

FOREIGN PATENT DOCUMENTS

FR 2516887 A1 5/1983
WO 92/19491 A1 11/1992

OTHER PUBLICATIONS

International Search Report from PCT/EP2013/059042 dated Sep. 13, 2013, 3 pages.
International Written Opinion from PCT/EP2013/059042 dated Sep. 13, 2013, 9 pages.

* cited by examiner

VOLUME ELEMENT

The present invention relates to a volume element according to the preamble of claim 1.

Such a volume element can be taken as known from US 2009/0049757 A1. There, the volume element is referred to as a sandwich beam, which is inflatable with a gas. To this, the sandwich beam has a core with at least one inner chamber inflatable with the gas. Therein, the inner chamber is bordered by an at least substantially flexible material.

Furthermore, a vacuum pocket is provided as at least one outer chamber, which is bordered by an at least substantially flexible material, which is referred to as a bag material. Therein, the outer chamber is fluidicially separated from the inner chamber and surrounds the inner chamber on the outer circumference at least in certain regions. A vacuum connection is provided, via which the outer chamber can be evacuated.

In the outer chamber, a compression element with two foil webs is provided, which are disposed in mutual overlap. By evacuating the outer chamber, it is downsized such that the foil webs are pressed onto each other. Thereby, the foil webs are clammed together by friction. For realizing particularly strong clamping together of the foil webs, the friction coefficient between them can be increased for example by using particles.

It has become apparent that this volume element referred to as sandwich beam has only an insufficient stiffness and strength in particular with respect to a pressure force load in its inflated state. This means that the volume element is very severely deformed if it is loaded with pressure forces.

Furthermore, from the general prior art, inflatable volume elements such as for example rubber rafts, life rafts or inflatable surfboards are known, which have a low pack size as well as a low weight due to their capability of being inflated such that they can be transported in very simple and space saving manner. By means of various manufacturing methods, for example by means of a drop-stitch method, a plurality of more or less complicated structures and geometries can be produced. These volume elements have the characteristic that they have a certain surface hardness with corresponding internal pressure, however, on the other hand have only a low stiffness. The low stiffness, which can also be referred to as a too low area element of inertia, is design related. By the internal pressure, a flexible outer skin of the corresponding volume element is put under tensile stress. Upon bending load of the volume element, this tensile stress is increased on one side of the volume element, whereas the tensile stress is decreased on the opposite side. If the bending moment is sufficiently high, thus, the tensile stress transitions to compressive stress in certain regions. However, since the flexible outer skin cannot absorb compressive stresses or only very low compressive stresses, buckling of the volume element occurs.

Therefore, it is the object of the present invention to further develop a volume element of the initially mentioned kind such that the volume element has increased stiffness in particular with respect to a pressure force stress.

This object is solved by a volume element having the features of claim 1. Advantageous configurations with convenient and non-trivial developments of the invention are specified in the remaining claims.

Such a volume element has at least one inner chamber bordered by an at least substantially flexible material, which is inflatable with a gas. Further, the volume element includes at least one outer chamber bordered by an at least substantially flexible material, which is fluidically separated from the at least one inner chamber and by which the inner chamber is surrounded on the outer circumference at least in certain regions.

For realizing higher stiffness of the volume element in particular with respect to pressure force loads, it is provided according to the invention that granular material for absorbing pressure forces acting on the volume element from the direction of the outer chamber is received in the outer chamber. The granular material thus serves for specifically stiffening the volume element such that the volume element can also absorb relatively high pressure forces or pressure force loads without undesired, initially described deformation of the volume element occurring. Such a pressure force load is absorbed and supported by the granular material. The granular material forms at least one closed layer, i.e. free of interruptions, for supporting the pressure force loads such that particles of the granular material can support on each other and absorb pressure forces.

For inflating the inner chamber, at least one first connection is provided, via which the gas, in particular air, can be introduced into the inner chamber. Preferably, at least one second connection associated with the outer chamber is provided, via which the outer chamber can be at least substantially evacuated. By evacuating or venting the outer chamber, the granular material including the particles is charged with a pressure force by means of the flexible material bordering the outer chamber such that the particles can support on each other and thus absorb pressure forces in particularly advantageous manner. This results in a particularly high stiffness and stability of the volume element.

It has proven advantageous if the inner chamber is at least predominantly surrounded by the outer chamber on the outer circumference. In other words, the inner chamber has an outer circumference surface, which is surrounded by the outer chamber at least in a predominant part. Thereby, particularly high stiffness of the volume element is provided.

In an advantageous embodiment of the invention, the outer chamber surrounds the inner chamber both on a first side of the volume element and on a second side of the volume element facing away from the first side at least in certain regions, in particular at least in predominant manner. Therein, granular material is preferably disposed in the outer chamber both on the first and on the second side of the volume element such that the granular material can very beneficially absorb and support the pressure force load acting on the volume element from different directions.

In further advantageous development of the invention, at least one second outer chamber fluidically separated from the first outer chamber at least in certain regions is provided. Therein, the inner chamber is surrounded by one of the two outer chambers on a first side of the volume element and by the other outer chamber on a second side of the volume element facing away from the first side at least in certain regions. Thereby, particularly high stiffness of the volume element can be realized. Therein, it is advantageously provided that granular material for absorbing pressure forces is provided in the two outer chambers. Thus, the volume element is particularly efficiently and effectively stiffened by the granular material.

The volume element is particularly efficiently stiffened by the granular material if the outer chamber has a volume fillable with the granular material, wherein the volume is completely, i.e. at 100%, filled with the granular material. Therein, the volume of the outer chamber fillable with the granular material relates to a volume capable of being maximally bordered by the flexible material, which the outer chamber can occupy by filling with the granular material and which is to be maximally filled with granular material, before damage or destruction for example by tearing of the outer chamber occurs.

If the outer chamber is completely, i.e. at 100%, filled with the granular material, thus, the flexible material bordering the outer chamber can very extensively abut the granular material and apply pressure forces to it for example by evacuating the outer chamber such that the volume element is then very stiff.

In a particularly advantageous embodiment of the invention, the flexible material of the outer chamber and/or of the inner chamber is substantially inelastic. This means that the flexible material is flexible, but at least substantially does not expand, i.e. does not increase in its length or extension, as a result of inflating or filling with the granular material. Thereby, very high robustness and stability are provided. The flexible material, which is preferably air-impermeable, is for example a fiber-reinforced plastic, in particular a fiber-reinforced elastomer, e.g. Hypalon.

In a further advantageous embodiment of the invention, the outer chamber is partially bordered by the at least substantially flexible material also at least partially bordering the inner chamber. In other words, the outer chamber is partially also bordered by the flexible material, by which the inner chamber is bordered. Hereby, the volume element can be produced with low material demand and thus in inexpensive manner. Further, the volume element thereby has only a very low weight as well as a low pack size.

The volume element has a particularly advantageous usability because it can be collapsed, in particular folded, in the non-inflated state of the inner chamber and thus has a low installation space requirement, i.e. a low pack size, on the one hand. Further, the volume element is very light with respect to its weight and accordingly is very simply to transport. On the other hand, the volume element has a very high stiffness in particular with respect to pressure force loads in the inflated state of the inner chamber.

It has proven further particularly advantageous if the inner chamber is bordered by a volume body, which is formed of the at least substantially flexible material bordering the inner chamber. Therein, the outer chamber is bordered partially by the volume body and partially by an area element at least partially surrounding the volume body on the outer circumference and formed of the at least substantially flexible material bordering the outer chamber. Thus, the volume element can be manufactured in inexpensive manner and beneficial to weight Advantageously, the volume body and the area element are connected to each other such that undesired relative movements of the area element to the volume body are avoided.

For realizing a particularly strong connection beneficial to weight of the volume body to the area element, they are preferably adhered to each other and/or stitched to each other.

The volume element is particularly advantageously usable as a water sports equipment, in particular as a surfboard, floating island, airbed or the like. This is the case since the volume element can be transported in very space saving manner due to its low installation space requirement, i.e. due to its low pack size in the non-inflated state of the inner chamber. Further, it has a very high stiffness in the inflated state of the inner chamber such that it very well satisfies its desired function despite of the realization of the low pack size and does not already deform with low pressure force loads.

A particularly high stiffness and stability of the volume element are achievable if the granular material at least partially includes a powder and/or sand and/or beads in particular of inorganic silicates. Alternatively or additionally, the beads can also be formed of foam glass. Foam glass is in particular characterized by its advantageous handling since it has a relatively large grain size.

With respect to the volume of the outer chamber fillable or filled with granular material and a volumetric capacity or capacity of the inner chamber maximally inflatable with the gas, the inner chamber and the outer chamber preferably have different volumes. In other words, the inner chamber and the outer chamber differ from each other with respect to their respective volume.

Therein, the volume of the inner chamber inflatable with the gas, i.e. the volumetric capacity or capacity of the inner chamber, relates to a volume capable of being maximally bordered by the flexible material associated with the inner chamber, which can occupy the inner chamber and which can be inflated with the gas without damage or destruction for example by tearing of the inner chamber occurring. By providing the volumes of the inner chamber and the outer chamber different from each other, characteristics of the volume element in particular with respect to its stiffness can be adequately adjusted.

If the inner chamber is inflated with the gas, in particular air, to a presettable pressure, thus, spanning of the outer chamber is thereby preferably also effected. Therein, ambient pressure prevails in the outer chamber, while overpressure with respect to the ambient pressure prevails in the inner chamber as the presettable pressure.

Related to this state referred to as reference state, the ratio between the volume of the inner chamber and the volume of the outer chamber is preferably at least 70:30. In other words, the volume of the inner chamber is at least 7/3 times larger than the volume of the outer chamber in the reference state. In particular, the ratio is 73:27. This results in a particularly high stiffness of the volume element with realization of a low weight and a low pack size at the same time.

The presettable pressure, to which the inner chamber is inflated for establishing the reference state, is in particular a pressure resulting in the formation of the maximum capacity or volumetric capacity of the inner chamber. In other words, if the flexible material bordering the inner chamber is at least substantially inelastic, thus, further pressure increase in the inner chamber starting from the presettable pressure does not or no longer result in a volume increase of the inner chamber since the flexible material bordering the inner chamber does not expand.

If the flexible material is elastic, thus, the presettable pressure can be a maximum pressure, to which the inner chamber can be maximally inflated without damage or destruction of the inner chamber occurring.

For realizing a particularly high stiffness of the volume element, advantageously, at least one second inner chamber and/or at least one second outer chamber are provided. Therein, the at least two inner chambers and/or the at least two outer chambers can differ from each other in particular related to the reference state with respect to their respective volumes.

Alternatively or additionally, it can be provided that the volume element has at least one cross-section, in which the at least two inner chambers differ from each other with respect to their respective cross-section and/or in which the at least two outer chambers differ from each other with respect to their respective cross-section.

Preferably, a main extension direction is provided, along which the inner chamber and the outer chamber have a respective main extension, which is larger than respective extensions along respective directions extending perpendicularly to each other and perpendicularly to the respective main extension direction. This means that the inner chamber and the outer chamber are substantially longer than high and wide.

Further advantages, features and details of the invention are apparent from the following description of preferred embodiments as well as based on the drawing. The features and feature combinations mentioned above in the description as well as the features and feature combinations mentioned below in the description of figures and/or shown in the figures alone are usable not only in the respectively specified combination, but also in other combinations or alone without departing from the scope of the invention.

Figure 2:
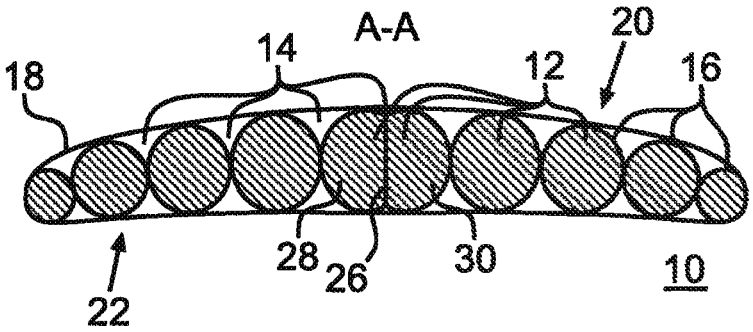
Figure 3:
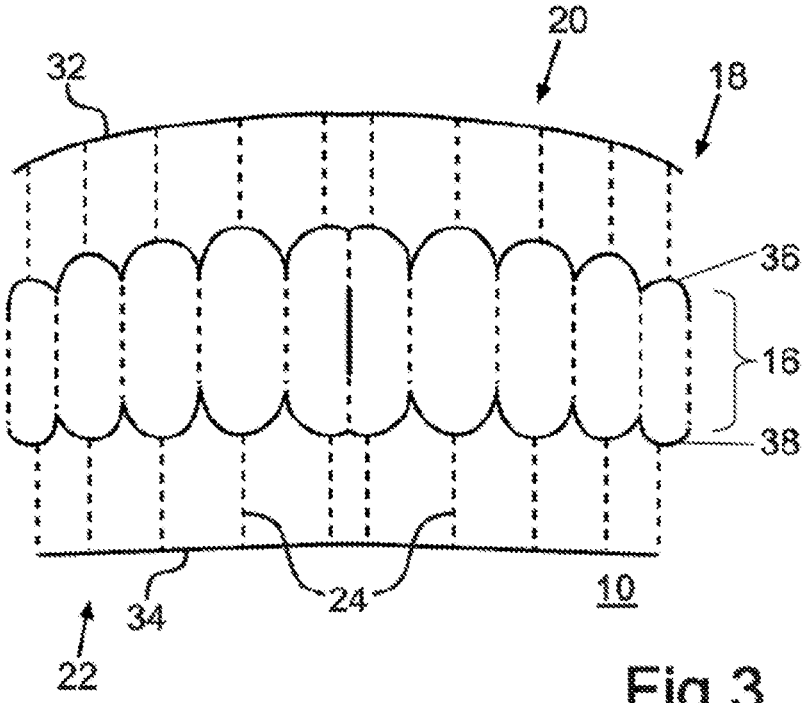
Figure 4:
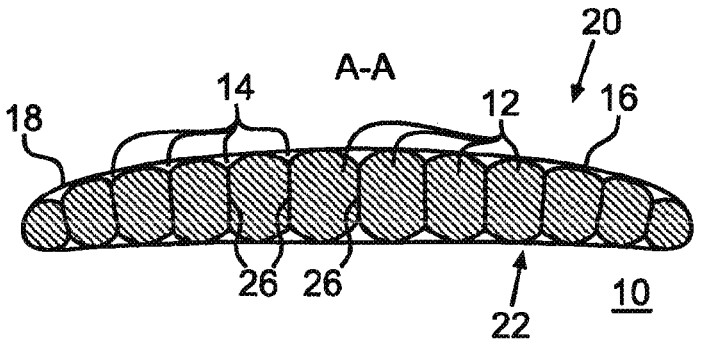
Figure 5:
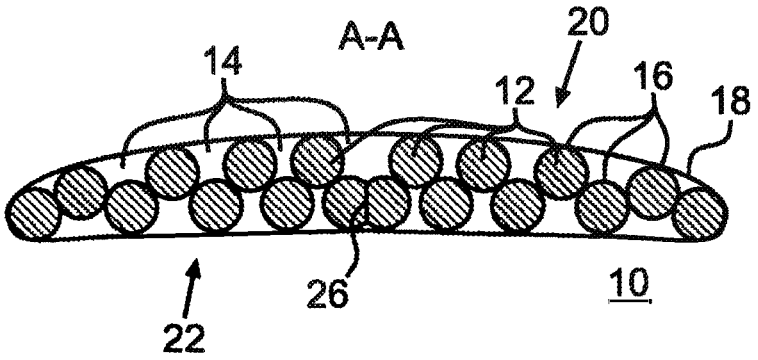
Figure 6:
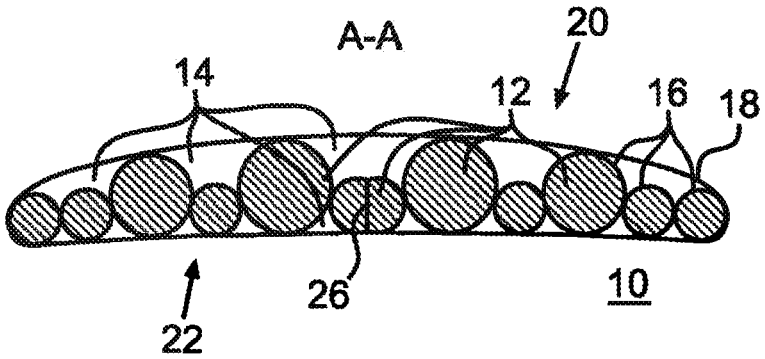
Figure 7:
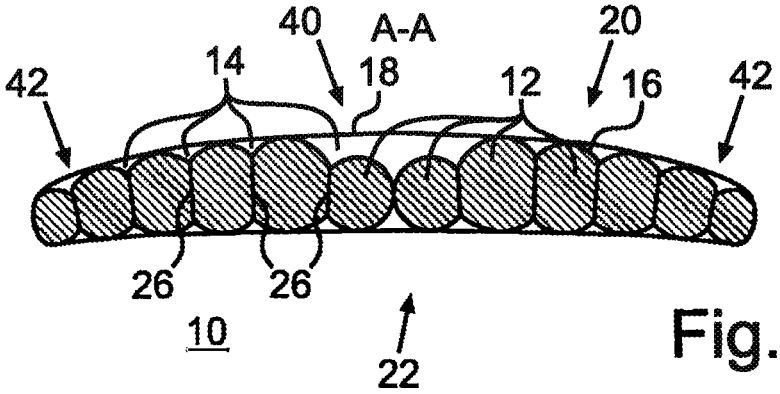
Figure 8:
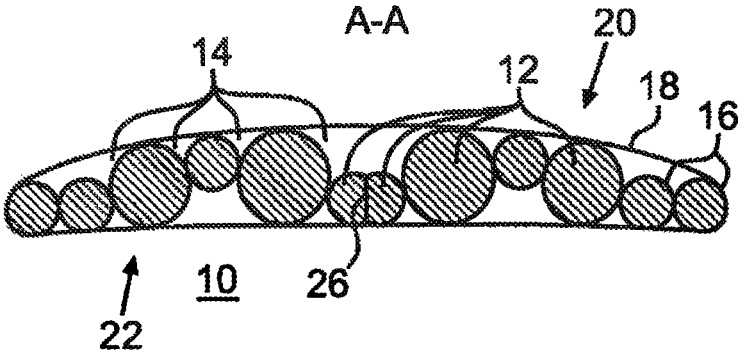
Figure 9:
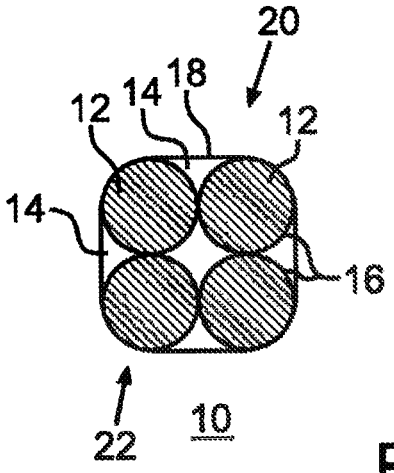

The drawing shows in:

FIG. 1 a schematic plan view of a volume element with a plurality of inner chambers and a plurality of outer chambers, wherein the outer chambers are filled with granular material for absorbing pressure forces acting on the volume element from the direction of the outer chambers;

FIG. 2 a schematic cross-sectional view of an embodiment of the volume element according to FIG. 1 along a sectional line A-A shown in FIG. 1;

FIG. 3 a schematic exploded illustration in a cross-sectional view of the volume element according to FIG. 2 to exemplify the production of the volume element;

FIG. 4 a schematic cross-sectional view of a further embodiment of the volume element according to FIG. 2;

FIG. 5 a schematic cross-sectional view of a further embodiment of the volume element according to FIG. 4;

FIG. 6 a schematic cross-sectional view of a further embodiment of the volume element according to FIG. 5;

FIG. 7 a schematic cross-sectional view of a further embodiment of the volume element according to FIG. 6;

FIG. 8 a schematic cross-sectional view of a further embodiment of the volume element according to FIG. 7; and FIG. 9 a schematic cross-sectional view of a further embodiment of the volume element.

FIG. 1 shows a volume element 10 presently formed as a water sports equipment in the form of an inflatable surfboard. As is apparent in synopsis with FIG. 2, the volume element has a plurality of inner chambers 12 bordered by a flexible and inelastic material. The inner chambers 12 are inflatable with a gas, in particular air, such that overpressure with respect to the ambient pressure prevails in the inner chambers 12. Therefore, the inner chambers 12 are also referred to as pressure chambers. Presently, the inner chambers 12 are shown in their inflated state.

For inflating the inner chambers 12, they each can have at least one connection. Alternatively, the inner chambers 12 can be combined to a connection common to the inner chambers 12, via which the inner chambers 12 are inflatable with the gas, in particular air.

The volume element 10 further includes a plurality of outer chambers 14 bordered by a flexible and inelastic material. Presently, the outer chambers 14 are capable of being vented or evacuated such that a negative pressure with respect to the ambient pressure is adjustable in the outer chambers 14. To this, the outer chambers 14 for example have at least one connection, via which they are capable of being evacuated. Alternatively, the outer chambers 14 are combined to a common connection, via which the outer chambers 14 are capable of being evacuated.

As is apparent from FIG. 2, the inner chambers 12 are bordered by respective volume bodies 16, which are formed of the flexible and inelastic material associated with the inner chambers 12.

The outer chambers 14 are bordered partially by the volume bodies 16 and thus partially by the flexible material also bordering the inner chambers 12. Further, the outer chambers 14 are partially bordered by an area element 18, which is formed of the flexible and inelastic material bordering the outer chambers 14. Therein, the area element 18 surrounds the volume bodies 16 on a first side 20 of the volume element 10 as well as on a second side 22 of the volume element 10 facing away from the first side 20. Thereby, the outer chambers 14 are disposed both on the first side 20 and on the side 22 and surround the inner chambers 12 both on the first side 20 and on the second side 22.

The area element 18 can be integrally formed. The area element 18 can also include a plurality of, i.e. at least two, area element parts, by means of which the outer chambers 14 are correspondingly bordered.

The flexible material bordering the inner chambers 12 is for example an air-impermeable fabric of a fiber-reinforced plastic, in particular of a fiber-reinforced elastomer. Similarly, the area element 18 can be formed of an air-impermeable fabric, for example of a fiber-reinforced plastic.

In FIG. 1, lines 24 are illustrated, which exemplify seams and/or adhesive beads, by means of which the area element 18 is stitched or adhered to the volume bodies 16.

A bordering element 26 is associated with the center inner chamber 12 related to the image plane of FIG. 2, by means of which the center inner chamber 12 is divided into two partial chambers 28, 30.

The outer chambers 14 serve for stiffening the structure of the volume element 10 and for establishing a finally desired shape of the volume element 10. To this, they are filled with a preferably very light granulate or powder and thus with a granular material. If the outer chambers 14 are evacuated, i.e. vented, thus, the outer chambers 14 are compressed by the higher ambient pressure and the flexible material abuts the granular material. Therein, the granular material prevents collapse of the outer chambers 14. Friction between individual particles of the granular material in the outer chambers 14 prevents slipping or other relative movement of the particles relative to each other. Thereby, the granular material and thereby the outer chambers 14 are hardened. By this hardening of the outer chambers 14, hard, stiff and stable partial areas of the volume element 10 can be generated, which are able to absorb pressure forces and therefore stiffen the volume element 10.

Since the material correspondingly bordering the inner chambers 12 and the outer chambers 14 is flexible, but inelastic, the flexible material is not expanded in inflating the inner chambers 12 and in filling the outer chambers 14.

Starting from a non-inflated, folded or collapsed state of the inner chambers 12, the inner chambers 12 can therefore be inflated up to a pressure with volume increase of the inner chambers 12, from which volume increase does no longer occur despite of optionally further pressure increase in the inner chambers 12.

This pressure, from which volume increase does no longer occur, is referred to as reference pressure. If the inner chambers 12 are inflated to this reference pressure, while ambient pressure prevails in the outer chambers 14, thus, this state of the volume element 10 is defined as a reference state.

In the reference state, therein, the outer chambers 14 filled with the granular material have a volume since they are spanned at least partially by inflating the inner chambers 12.

In this reference state, the outer chambers 14 are preferably completely filled with the granular material. Hereby, the volume of the outer chambers 14 does not decrease or only very slightly decrease in evacuating such that the area element 18 is able to particularly well abut the granular material in particular without crinkling and folds.

If the respective volumes of the inner chambers 12 are summed up in the reference state, thus, they have a first overall volume. If the respective volumes of the outer chambers 14 are correspondingly summed up in the reference state, thus, they also have a second overall volume. Therein, the ratio between the first overall volume and the second overall volume is preferably at least 70:30. Thereby, the volume element 10 has a particularly high stiffness in the inflated state. On the other hand, the pack size of the volume element 10 in its folded or collapsed state can thereby be kept particularly low.

In order to again bring the volume element 10 into a shape beneficial for the transport after use, the outer chambers 14 are flooded with air, which allows relative displacement of the particles of the granular material.

The granular material can include micro-balloons or foam glass beads as particles. They have a low bulk weight and are high-pressure resistant. Further, other particle materials, for example sand, rice, coffee etc., can also be used.

Inflatable elements such as the volume bodies 16 have the property of seeking a round shape if they are charged with an internal overpressure. By inserting the bordering element 26, for example by means of a drop-stitch method, however, other shapes can also be established, which then have round shapes only in some places. This is in particular advantageous in the production of inflatable surfboards since they preferably have a flat or plane surface, on which a person can stand.

According to application case, it can be advantageous that the volume element 10 has a high bending stiffness in first partial areas, but has a high bending elasticity in second partial areas different therefrom. The bending stiffness and the bending elasticity, respectively, can be adjusted via the area ratio or volume ratio of inner chambers 12 to outer chambers 14. Related to a corresponding cross-section of the volume element 10, a very great area portion of the inner chambers 12 with respect to a lower area portion of the outer chambers 14 results in a bending elastic structure. If the area portion of the outer chambers 14 is greater in comparison and the area portion of the inner chambers 12 is lower in comparison, thus, a bending stiff structure is provided. Furthermore, the stiffness of the volume element 10 can be adjusted via the corresponding overpressure in the inner chambers 12 or via the negative pressure in the outer chambers 14.

FIG. 3 illustrates a method for producing the volume element 10 according to FIG. 2. As is apparent based on FIG. 3, the area element 18 includes area element parts 32, 34, wherein the area element part 32 is disposed on the first side 20 and the area element part 34 is disposed on the second side 22. The area element parts 32, 34 are—as illustrated by the lines 24—stitched and/or adhered to the volume bodies 16.

The volume bodies 16 are formed by two further area elements 36, 38, which are for example formed as respective fabric layers. However, the fabric layers (area elements 36, 38) are also adhered and/or stitched to each other.

FIG. 4 shows a further embodiment of the volume element 10, wherein a plurality of bordering elements 26 is provided. As it is recognizable based on a comparison to the volume element 10 according to FIG. 2, the outer circumference round shape of the volume bodies 16 can be kept low by the bordering elements 26. Moreover, the area portion of the inner chambers 12 is substantially larger than according to FIG. 2. Correspondingly, the area portion of the outer chambers 14 is smaller.

According to FIG. 5, the area portion of the outer chambers 14 is substantially larger than according to FIG. 4. Correspondingly, the area portion of the inner chambers 12 is lower. Thereby, in comparison to FIG. 4, a relatively high bending stiffness of the volume element 10 is provided.

FIG. 6 shows a further embodiment of the volume element 10. Therein, the area portion of the inner chambers 12 on the second side 22 is larger than on the first side 20. Thus, the volume element 10 is very bending stiff in one direction and bending elastic in the correspondingly opposite direction.

According to FIG. 7, in a center area 40 of the volume element 10, the area portion of the outer chambers 14 is larger than in lateral outer areas 42. Thus, the volume element 10 has partially a high bending stiffness and partially a relatively high bending elasticity.

Based on FIGS. 4 to 7, it is thus recognizable that the bending stiffness as well as the bending elasticity of the volume element 10 can also be adjusted by corresponding arrangement of the inner chambers 12 and the outer chambers 14 as well as by partial variation of the respective area portions.

FIG. 8 shows a further possibility of adequately adjusting the bending stiffness such that the volume element 10 has at least one cross-section, wherein the at least one cross-section has at least two partial cross-sectional areas, in which the respective area ratios between the inner chambers 12 and the outer chambers 14 differ from each other.

FIG. 9 shows a further embodiment of the volume element 10. The volume element 10 has a substantially square cross-section with rounded corners in its reference state. The volume element 10 according to FIG. 9 is for example a table leg for a table.

As is recognizable based on FIGS. 1 to 9, inflatable, substantially rod-shaped structures can be presented by the volume element 10, which have a particularly high stiffness, in particular with respect to pressure force loads, by the outer chambers 14 and in particular by the granular material received in the outer chambers 14, but have a very low pack size and thus a low installation space requirement by venting the inner chambers 12 and by folding or collapsing.

LIST OF REFERENCE CHARACTERS

10 Volume element
12 Inner chamber
14 Outer chambers
16 Volume body
18 Area element
20 First side
22 Second side
24 Line
26 Bordering element
28 Partial chamber
30 Partial chamber
32 Area element part
34 Area element part
36 Area element

38 Area element
40 Center area
42 Outer area

The invention claimed is:

1. A volume element comprising:

a first body comprising a first inner chamber, the first body formed by at least two joined sheets of fiber-reinforced plastic, the first inner chamber inflatable with a gas, a second body comprising a second inner chamber, the second body formed by at least two joined sheets of fiber-reinforced plastic, the second inner chamber inflatable with a gas, an area element in the form of a sheet of fabric joined to a first side of the first body and a first side of the second body, the first body further joined to the second body to form an outer chamber located between a portion of the first body and a portion of the second body, the outer chamber bordered by the portion of the first body, the portion of the second body, and the area element, the outer chamber fluidically separated from the first and second inner chambers, the outer chamber substantially filled with granular material for absorbing pressure forces acting on the volume element from the direction of the outer chamber.

2. The volume element according to claim 1, further comprising a second area element in the form of a sheet of fabric, the second area element joined to a second side of the first body and a second side of the second body.

3. The volume element according to claim 1, wherein the outer chamber is completely filled with the granular material.

4. The volume element according to claim 1, wherein the volume element is formed as a water sports equipment.

5. The volume element according to claim 1, wherein the volume element comprises a third inner chamber.

6. The volume element according to claim 5, wherein each inner chamber of the plurality of inner chambers is joined to at least one other inner chamber.

7. The volume element according to claim 1, wherein the outer chamber is substantially evacuated of gas.

8. The volume element according to claim 1, further comprising a second outer chamber, the outer chamber and the second outer chamber positioned on opposite sides of the first inner chamber.

9. An inflatable element comprising:

first and second sheets of fiber-reinforced plastic, the first and second sheets joined to one another at a plurality of locations to form a plurality of joined inner chambers;

a third sheet comprising fiber-reinforced plastic, the third sheet joined to each of the inner chambers to form a first plurality of outer chambers on a first side of the plurality of inner chambers; and a fourth sheet comprising fiber-reinforced plastic, the fourth sheet joined to each of the inner chambers to form a second plurality of outer chambers on a second side of the plurality of inner chambers;

wherein each outer chamber of the first plurality of outer chambers and second plurality of outer chambers is filled with a granular material and located between at least two inner chambers.

10. The volume element according to claim 9, wherein the first plurality of outer chambers are substantially evacuated of gas.

11. The volume element according to claim 9, wherein a ratio of an overall volume of the inner chambers and an overall volume of the outer chambers is at least 70:30.

12. The volume element according to claim 11, wherein the first, and second sheets are inelastic.

13. A volume element comprising:

a first inner chamber surrounded by inelastic fiber-reinforced plastic, the first inner chamber inflatable with a gas, a second inner chamber surrounded by the inelastic fiber-reinforced plastic, the second inner chamber inflatable with a gas, a first outer chamber bordered at least in part by a first sheet of fiber-reinforced plastic, the first inner chamber, and the second inner chamber, the first sheet joined to the fiber-reinforced plastic surrounding the first inner chamber and also joined to the fiber-reinforced plastic surrounding the second inner chamber to form the first outer chamber, the first outer chamber fluidically separated from the first inner chamber and the second inner chamber, a second sheet of fiber-reinforced plastic joined to the fiber-reinforced plastic surrounding the first inner chamber and also joined to the fiber-reinforced plastic surrounding the second inner chamber to form a second outer chamber, the second sheet joined to the first and second inner chamber on sides opposite the first sheet, the second outer chamber fluidically separated from the first inner chamber and the second inner chamber, and the first and second outer chambers substantially filled with granular material for absorbing pressure forces acting on the volume element.

14. The volume element according to claim 13, wherein the outer chamber is evacuated of gas.

* * * * *